US008746019B2

(12) United States Patent
Chung et al.

(10) Patent No.: US 8,746,019 B2
(45) Date of Patent: Jun. 10, 2014

(54) TUB WITH OVERFLOW AND WASHING MACHINE HAVING THE SAME

(75) Inventors: Seung Hwan Chung, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 407 days.

(21) Appl. No.: 12/654,970

(22) Filed: Jan. 11, 2010

(65) Prior Publication Data

US 2010/0175436 A1 Jul. 15, 2010

(51) Int. Cl.
*D06F 37/26* (2006.01)

(52) U.S. Cl.
USPC ..... 68/208

(58) Field of Classification Search
USPC ..... 68/3 R, 208
See application file for complete search history.

(56) References Cited

U.S. PATENT DOCUMENTS

| | | | | |
|---|---|---|---|---|
| 3,494,152 | A * | 2/1970 | Pick | 68/13 R |
| 3,872,694 | A * | 3/1975 | Sikamori et al. | 68/12.16 |
| 4,372,134 | A * | 2/1983 | Matsuo | 68/12.02 |
| 5,291,758 | A * | 3/1994 | Lee | 68/196 |
| 6,634,194 | B1 * | 10/2003 | Watkins | 68/147 |

FOREIGN PATENT DOCUMENTS

| | | | |
|---|---|---|---|
| JP | 52-128657 | * | 10/1977 |
| JP | 02-255184 | * | 10/1990 |
| JP | 05-031287 | * | 2/1993 |
| JP | 05-092097 | * | 4/1993 |
| JP | 08-141280 | * | 6/1996 |
| JP | 2000-070591 | * | 3/2000 |
| JP | 2004-236800 | * | 8/2004 |
| KR | 10-2000-0065941 | | 11/2000 |
| KR | 2003020765 | * | 3/2003 |
| KR | 2003055970 | * | 7/2003 |

OTHER PUBLICATIONS

Machine translation of JP 2000-070591 A, published Mar. 7, 2000.*
Machine translation of JP 2004-236800 A, published Aug. 26, 2004.*

* cited by examiner

*Primary Examiner* — Joseph L Perrin
(74) *Attorney, Agent, or Firm* — Staas & Halsey LLP

(57) ABSTRACT

Disclosed herein is a washing machine including an overflow defined through a portion of one side of an upper part of a tub and formed in the shape of a cutout and guide ribs protruding from the outer circumference of the tub to guide wash water drained through the overflow. The overflow is formed by cutting one side of the upper part of the tub, so that the washing machine has a simple overflow structure.

7 Claims, 3 Drawing Sheets

TUB WITH OVERFLOW AND WASHING MACHINE HAVING THE SAME

CROSS-REFERENCE TO RELATED APPLICATIONS

This application claims the benefit of Korean Patent Application No. 2009-0002480, filed on Jan. 13, 2009 in the Korean Intellectual Property Office, the disclosure of which is incorporated herein by reference.

BACKGROUND

1. Field

The embodiment relates to a washing machine having an overflow structure to forcibly drain wash water from a tub.

2. Description of the Related Art

Generally, a washing machine includes a cabinet forming an external appearance of the washing machine, a tub installed in the cabinet to receive wash water, a spin basket rotatably installed in the tub, the spin basket having a pulsator mounted therein, and a drive unit to rotate the pulsator and the spin basket.

The washing machine washes laundry placed in the spin basket by the friction between the laundry and wash water motion formed by rotating the pulsator and the spin basket at high velocity using the drive unit, by the emulsification of detergent, and by impact applied to the laundry from the pulsator.

Meanwhile, an overflow is connected to the washing machine to forcibly drain wash water, when the wash water in the tub reaches a predetermined water level, to prevent various electronic components from being damaged by the wash water overflowing from the tub. The overflow is connected to a hole formed at one side of the upper part of the tub.

Since the overflow is connected to the hole of the tub, the hole of the tub is bonded to prevent the leakage of water through the hole.

Also, the overflow extends downward along the outer wall of the tub. The overflow may be fixed by a wire such that the overflow is prevented from shaking due to vibration generated during washing.

That is, the overflow is provided to drain wash water from the tub when the wash water reaches a predetermined water level, the overflow is fixed to prevent the shaking of the overflow, and the connection between the hole of the tub and the overflow is bonded to prevent the leakage of water through the connection.

SUMMARY

Therefore, it is an aspect of the present embodiment to provide a washing machine having a simple overflow structure to drain wash water from a tub when the wash water reaches a predetermined water level.

Additional aspects will be set forth in part in the description which follows and, in part, will be obvious from the description, or may be learned by practice of the invention.

The foregoing and/or other aspects are achieved by providing a washing machine, including a cabinet and a tub installed in the cabinet to receive wash water, the tub including an overflow defined through a portion of one side of an upper part of the tub to drain wash water to prevent the wash water from overflowing the tub, the overflow being formed at the side of the upper part of the tub in a shape of a cutout.

The tub may have a pair of guide ribs protruding from an outer circumference thereof to guide the wash water drained through the overflow.

The guide ribs may be disposed at opposite sides of the overflow, respectively.

The guide ribs may extend in a longitudinal direction of the tub.

The guide ribs may extend in a downward direction from an upper end of the tub.

A lower end of the overflow may be disposed lower than an upper end of the tub.

The side of the tub body that the overflow is disposed at may not be in the vicinity of a drive unit or a drainage unit of the washing machine.

The foregoing and/or other aspects are achieved by providing a tub of a washing machine, including a tub body to receive wash water, and an overflow to drain wash water to prevent the wash water from overflowing the tub defined through a portion of one side of an upper part of the tub body, the overflow being formed at the side of the upper part of the tub body in a shape of a cutout such that a lower end of the overflow is lower than an upper end of the tub body.

The tub body may have a pair of guide ribs protruding from an outer circumference thereof to guide the wash water drained through the overflow.

The guide ribs may be disposed at opposite sides of the overflow, respectively.

The guide ribs may extend from an upper end to a lower end of the tub.

The side of the tub body that the overflow is disposed at may not be in the vicinity of a drive unit or a drainage unit of the washing machine.

BRIEF DESCRIPTION OF THE DRAWINGS

These and/or other aspects will become apparent and more readily appreciated from the following description of the embodiment, taken in conjunction with the accompanying drawings of which.

DETAILED DESCRIPTION OF EMBODIMENTS

Figure 1:
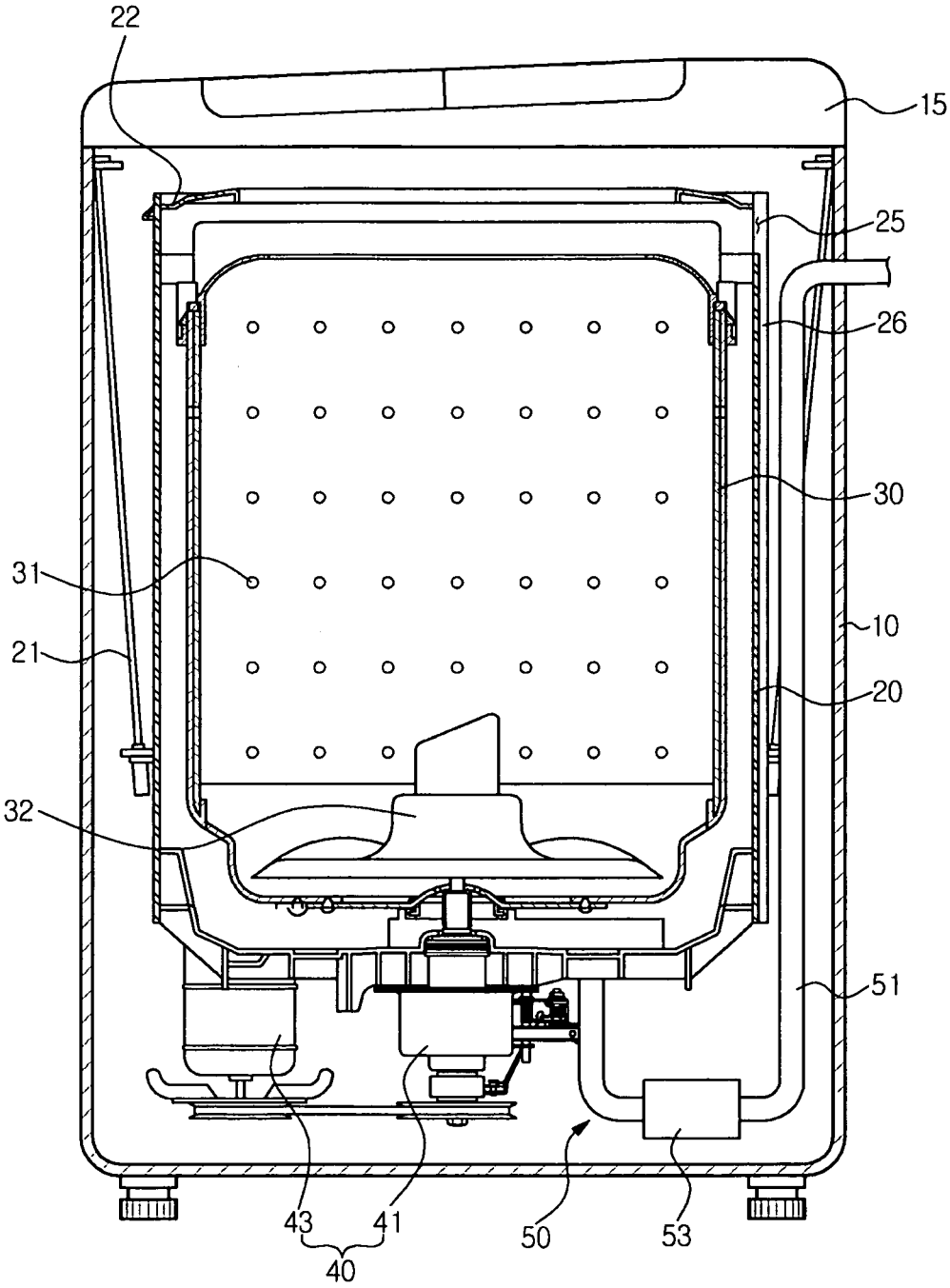
FIG. 1 is a sectional view illustrating a washing machine according to an embodiment.

Reference will now be made in detail to the embodiment, examples of which are illustrated in the accompanying drawings, wherein like reference numerals refer to the like elements throughout.

Figure 2:
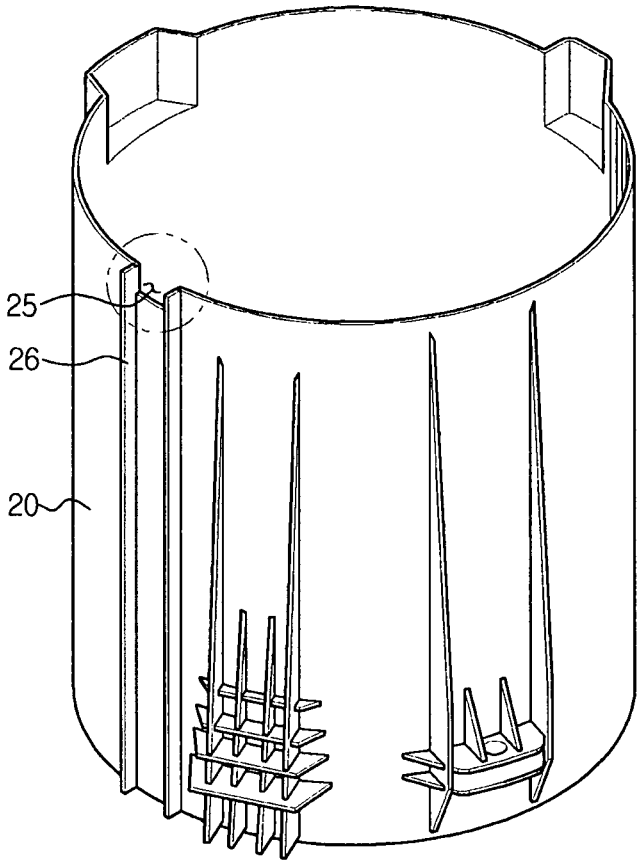
FIG. 2 is a perspective view illustrating a tub shown in FIG. 1.

As shown in FIGS. 1 and 2, a washing machine according to an embodiment includes a cabinet 10 forming an external appearance of the washing machine, a tub 20 installed in the cabinet 10, a spin basket 30 rotatably installed in the tub 20, the spin basket 30 having a pulsator 32 mounted therein, and a drive unit 40 installed below the tub 20 to rotate the spin basket 30 and the pulsator 32.

A cover 15 having a laundry inlet port (not shown) to allow laundry to be put into or removed from the spin basket 30 is installed above the cabinet 20. A door to open and close the laundry inlet port is hingedly coupled to the cover 15.

The tub 20 is installed in the cabinet 10 to receive wash water. A suspension system 21 to suspend the tub 20 from the cabinet 10 is connected to the outer circumference of the tub 20. A ring-shaped tub cover 22 to cover the tub 20 is disposed at an upper end of the tub 20.

The spin basket 30 is rotatably installed in the tub 20. The spin basket 30 has a plurality of through-holes 31 through which the inner space of the spin basket 30 communicates with the inner space of the tub 20.

The pulsator 32 is rotatably mounted at the bottom of the spin basket 30. The pulsator 32 serves to agitate laundry placed in the spin basket 30 together with wash water.

The drive unit 40 includes a clutch 41 to rotate the spin basket 30 and the pulsator 32 and a drive motor 43 to drive the clutch 41. The drive motor 43 is connected to the clutch 41 via a pulley and a belt to transmit a drive force to the clutch 41.

The washing machine further includes a water supply unit (not shown) to supply water, a detergent supply unit (not shown) to dissolve detergent in the supplied water, and a drainage unit 50 to drain wash water remaining in the tub 20 after the completion of washing to the outside.

The water supply unit is installed at one side of the cover 15. The water supply unit includes a water supply valve (not shown) to control the supply of water and a water supply pipe (not shown) connected between the water supply valve and the detergent supply unit.

The detergent supply unit includes a case (not shown) disposed in the cover 15 and a detergent box (not shown) detachably mounted in the case to receive various kinds of detergent.

The drainage unit 50 is installed below the tub 20 to drain wash water from the tub 20. The drainage unit 50 includes a drainage pipe 51 connected to a drainage port formed at the bottom of the tub 20 to guide the drainage of wash water and a drainage pump 53 mounted on the drainage pipe 51.

Figure 3:
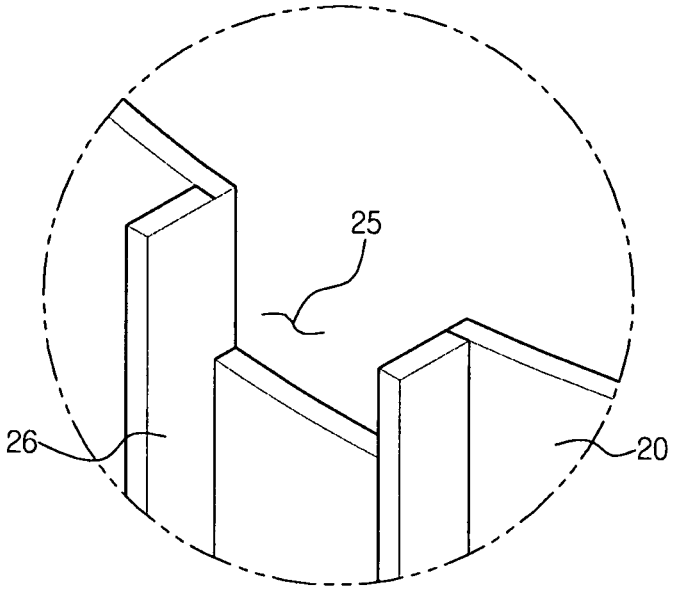
FIG. 3 is an enlarged view illustrating a principal part of the tub shown in FIG. 2.

Meanwhile, as shown in FIGS. 2 and 3, the tub 20 has an overflow 25 defined through a portion of the tub 20 to forcibly drain wash water out of the tub 20 when the wash water reaches a predetermined water level. Wash water is forcibly drained through the overflow 25 such that the wash water is forcibly drained to an intended spot where various electronic components, such as the drive unit 40 and the drainage unit 50, are not located to prevent the electronic components from being damaged by wash water overflowing from the tub 20.

The overflow 25 is provided at one side of the upper part of the tub 20. The overflow 25 is formed by cutting a predetermined portion of the tub 20 from the upper end of the tub 20 downward. That is, the overflow 25, that is defined through a portion of one side of the upper part of the tub 20, is formed in the shape of a cutout. The overflow 25 is configured such that the lower end of the overflow 25 is lower than the upper end of the tub 20.

As shown, the overflow 25 is formed in the shape of a rectangular cutout. The overflow 25 may be formed in various shapes as long as the overflow 25 forcibly drains wash water from the tub 20.

From the outer circumference of the tub 20 protrude guide ribs 26 to guide wash water forcibly drained through the overflow 25. The guide ribs 26 make a pair. The guide ribs 26 are disposed at opposite sides of the overflow 25, respectively.

Also, the guide ribs 26 extend from the upper end to the lower end of the tub 20. That is, the guide ribs 26 are formed in the longitudinal direction of the tub 20.

Hereinafter, a process of forcibly draining wash water from the tub in the washing machine with the above-stated construction will be described.

First, one side of the upper part of the tub 20 is cut to form the overflow 25 to drain wash water in the tub 20 to an intended spot when the wash water reaches a predetermined water level.

That is, when the wash water in the tub 20 reaches the predetermined water level, the wash water is forcibly drained out of the tub 20 through the overflow 25, formed by cutting through one side of the upper part of the tub 20.

The wash water, forcibly drained through the overflow 25, falls downward along the outer circumference of the tub 20 while being guided by the guide ribs 26 protruding from the outer circumference of the tub 20.

The wash water, forcibly drained through the overflow and guided by the guide ribs 26, falls to a spot where various electronic components, such as the drive unit 40 and the drainage unit 50, are not located, so that the electronic components are prevented from being damaged by the wash water.

In this embodiment, therefore, the overflow 25 is provided by cutting one side of the upper part of the tub 20, whereby wash water is forcibly drained from the tub without an additional component, such as a conventional overflow pipe, when the wash water reaches a predetermined water level.

Also, in this embodiment, the overflow 25 has a simple structure, as compared with conventional washing machines in which an overflow pipe connected to a hole formed at the tub is fixed, or the hole of the tub is bonded to prevent the leakage of water through the overflow pipe, thereby reducing material costs and labor costs.

As is apparent from the above description, the washing machine according to the embodiment has an overflow formed by cutting one side of the upper part of the tub.

Also, the overflow has a simple structure, thereby reducing the manufacturing costs of the washing machine.

Although an embodiment has been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a cabinet;

a tub installed in the cabinet to receive wash water, the tub including an overflow defined through a portion of one side of the tub to drain wash water to prevent the wash water from overflowing the tub, the overflow being formed at a topmost circumference of the tub in a shape of a rectangular cutout; and a pair of guide ribs protruding from an outer circumference of the tub to guide the wash water drained through the overflow, wherein the guide ribs extend longitudinally in a downward direction from an upper end of the tub to a lower end of the tub, and upper ends of the guide ribs are positioned at a height that is substantially same as a height of the topmost circumference of the tub and lower ends of the guide ribs extend to a height that is substantially same as a height of a lowermost circumference of the tub such that the wash water being drained through the overflow is prevented from leaking outside of the guide ribs through the upper ends of the guide ribs.

2. The washing machine according to claim 1, wherein the guide ribs are disposed at opposite sides of the overflow, respectively.

3. The washing machine according to claim 1, wherein a lower end of the overflow is disposed lower than an upper end of the tub.

4. The washing machine according to claim 1, wherein the side of the tub body that the overflow is disposed at is not in the vicinity of a drive unit or a drainage unit of the washing machine, and the overflow guides the wash water to a location away from the drive unit and the drainage unit so that neither the drive unit nor the drainage unit are damaged by the wash water.

5. A tub of a washing machine, comprising:

a tub body to receive wash water;

an overflow to drain wash water to prevent the wash water from overflowing the tub defined through a portion of one side of the tub body, the overflow being formed at a topmost circumference of the tub body in a shape of a rectangular cutout such that a lower end of the overflow is lower than an upper end of the tub body, and a pair of guide ribs protruding from an outer circumference of the tub body to guide the wash water drained through the overflow, wherein the guide ribs extend longitudinally in a downward direction from an upper end of the tub body to a lower end of the tub body, and upper ends of the guide ribs are positioned at a height that is substantially same as a height of the topmost circumference of the tub body and lower ends of the guide ribs extend to a height that is substantially same as a height of a lowermost circumference of the tub body such that the wash water being drained through the overflow is prevented from leaking outside of the guide ribs through the upper ends of the guide ribs.

6. The tub according to claim 5, wherein the guide ribs are disposed at opposite sides of the overflow, respectively.

7. The tub according to claim 5, wherein the side of the tub body that the overflow is disposed at is not in the vicinity of a drive unit or a drainage unit of the washing machine, and the overflow guides the wash water to a location away from the drive unit and the drainage unit so that neither the drive unit nor the drainage unit are damaged by the wash water.

* * * * *

UNITED STATES PATENT AND TRADEMARK OFFICE

CERTIFICATE OF CORRECTION

PATENT NO. : 8,746,019 B2
APPLICATION NO. : 12/654970
DATED : June 10, 2014
INVENTOR(S) : Chung et al.

It is certified that error appears in the above-identified patent and that said Letters Patent is hereby corrected as shown below:

On the Title Page below Item (22) insert
Item -- [30] (Foreign Application Priority Data), Korean Patent Application No. 2009-0002480, filed January 13, 2009 --

Signed and Sealed this
Thirteenth Day of January, 2015

Michelle K. Lee

Michelle K. Lee
*Deputy Director of the United States Patent and Trademark Office*